US010222015B2

(12) United States Patent
Chien

(10) Patent No.: US 10,222,015 B2
(45) **Date of Patent: *Mar. 5, 2019**

(54) LED LIGHT HAS MORE THAN ONE OPTICS MEANS HAVING REFLECTIVE AND/OR REFRACTIVE PROPERTIES TO CREATE WIDER VIEWING ANGLE IMAGE

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/323,318

(22) Filed: Jul. 3, 2014

(65) Prior Publication Data

US 2015/0070886 A1 Mar. 12, 2015

Related U.S. Application Data

(63) Continuation of application No. 14/023,889, filed on Sep. 11, 2013.

(51) Int. Cl.

| | |
|---|---|
| ***F21S 10/06*** | (2006.01) |
| ***F21S 10/02*** | (2006.01) |
| ***F21S 6/00*** | (2006.01) |
| ***F21V 21/14*** | (2006.01) |
| ***F21V 23/04*** | (2006.01) |
| *F21S 9/02* | (2006.01) |
| *F21Y 115/10* | (2016.01) |

(52) U.S. Cl.

CPC ..... *F21S 10/063* (2013.01); *F21S 6/002* (2013.01); *F21S 10/02* (2013.01); *F21S 10/023* (2013.01); *F21V 21/14* (2013.01); *F21V 23/0442* (2013.01); *F21S 9/02* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 4,258,513 | A * | 3/1981 | Bergman | E04B 1/3211 52/81.1 |
| 4,456,258 | A * | 6/1984 | Lodrick | A63F 3/00176 273/241 |
| 5,324,224 | A * | 6/1994 | Anderson | A63H 33/26 362/184 |
| 6,793,355 | B1 * | 9/2004 | Leung | G02B 7/1821 359/850 |
| 7,192,329 | B2 * | 3/2007 | Lee | A63H 33/04 428/34.1 |
| 2006/0152946 | A1 * | 7/2006 | Chien | 362/641 |
| 2008/0304289 | A1 * | 12/2008 | Chien | 362/641 |
| 2010/0213879 | A1 * | 8/2010 | Chien | 315/314 |
| 2013/0107520 | A1 * | 5/2013 | O'Kane | F21V 14/04 362/235 |

* cited by examiner

*Primary Examiner* — Elmito Breval

(74) *Attorney, Agent, or Firm* — Bacon & Thomas, PLLC

(57) ABSTRACT

An LED night light having different power sources including a battery, outlet plug-in power source, or interchangeable power source incorporates geometric shape optics means having more than one reflective means situated at different positions, distances, and/or orientations so that light beams will be reflected multiple times by more than one reflector means before passing through the reflectors' optics means and being projected to an external surface(s) such as a ceiling, wall, or floor.

9 Claims, 4 Drawing Sheets

Fig. 1
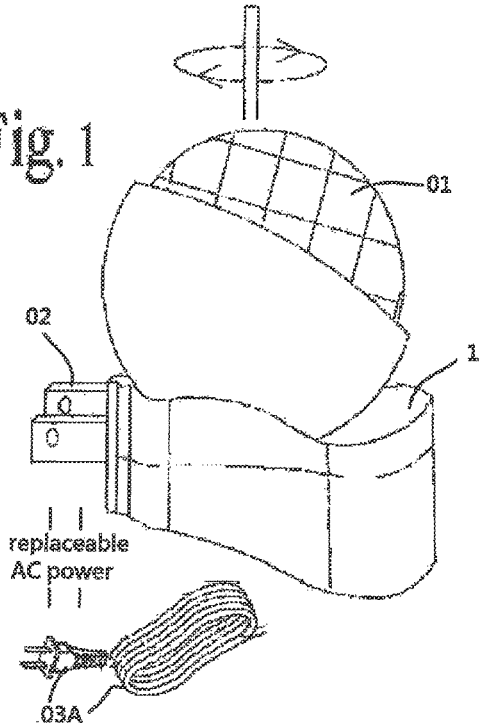
Fig. 1-1
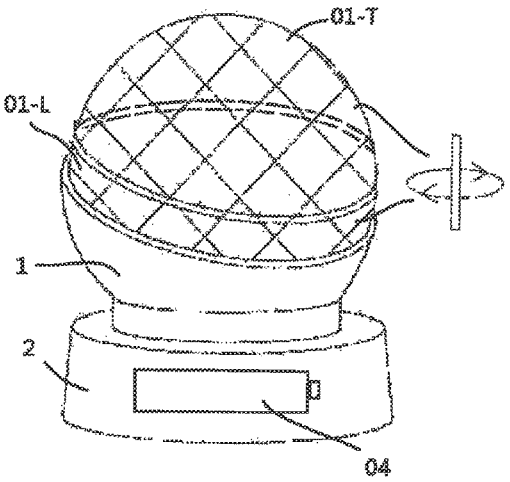
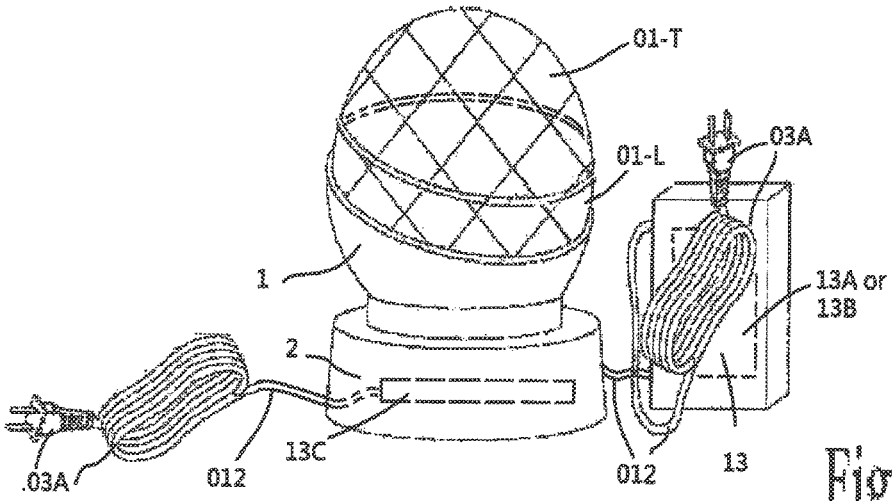
Fig. 1-2

Fig. 2
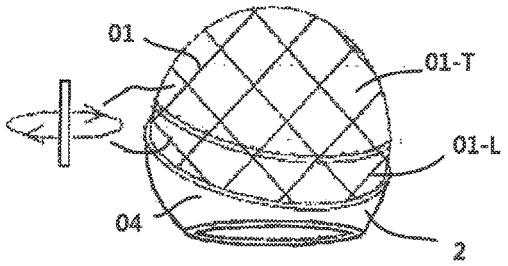
Fig. 2-1
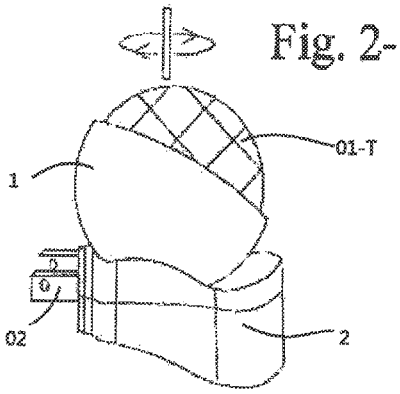
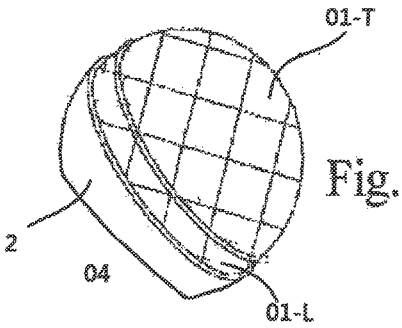
Fig. 2-2
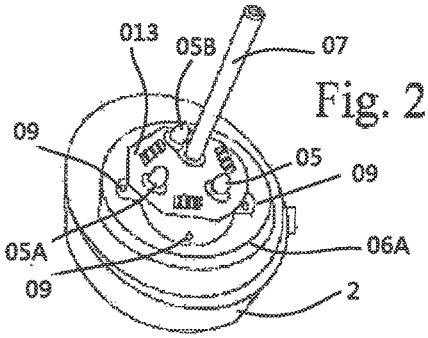
Fig. 2-3
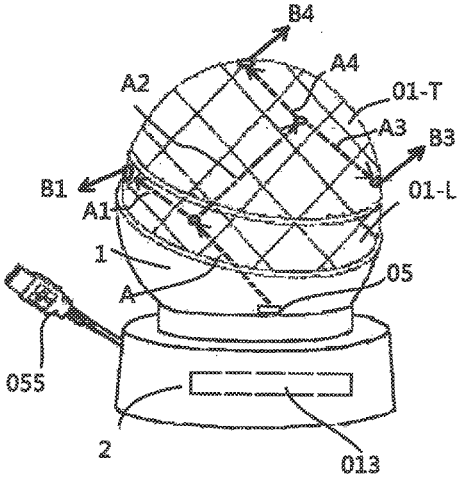
Fig. 2-5
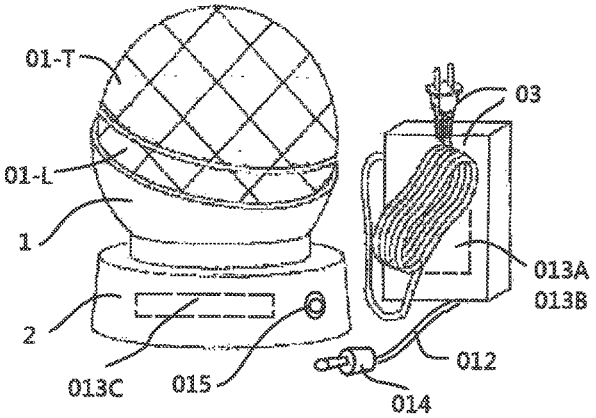
Fig. 2-4

Fig 4
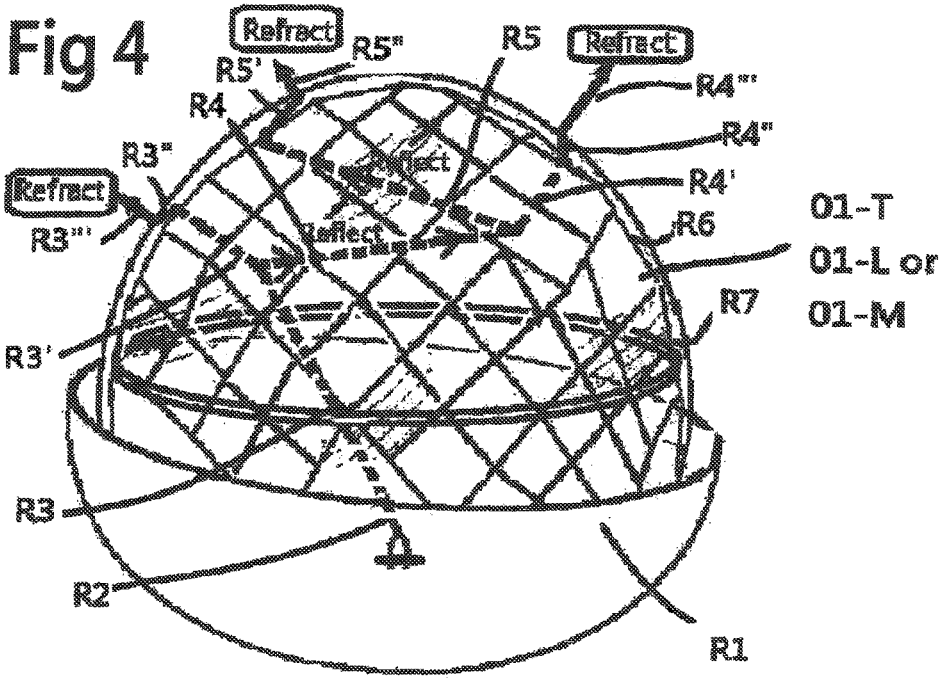
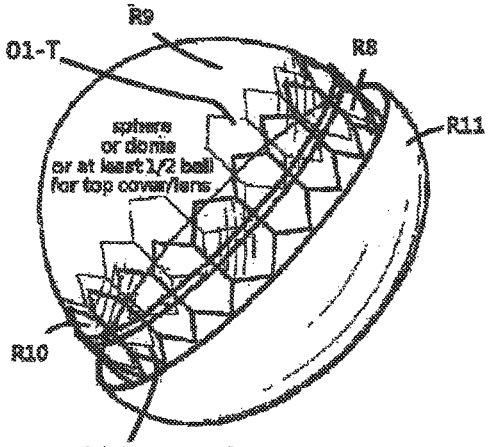
Fig 4-1
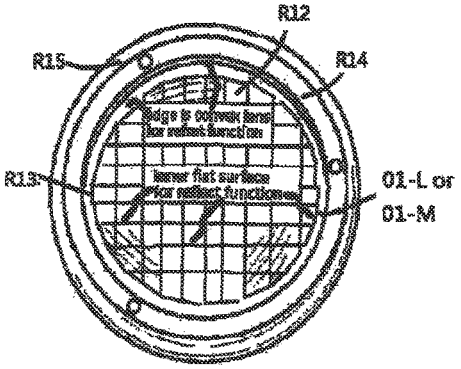
Fig 4-2

LED LIGHT HAS MORE THAN ONE OPTICS MEANS HAVING REFLECTIVE AND/OR REFRACTIVE PROPERTIES TO CREATE WIDER VIEWING ANGLE IMAGE

BACKGROUND OF THE INVENTION

The current application has features in common with the projection light devices disclosed in the inventor's U.S. patent application Ser. No. 14/024,229 ("LED light has kaleidoscope means"), filed Sep. 11, 2013; Ser. No. 13/021,124 ("LED light has changeable image and pattern by kaleidoscope means to project to surfaces"), filed Feb. 4, 2011, and published on Aug. 9, 2012 as U.S. Pat. Pub. No. 2012-0200828; Ser. No. 12/710,918 ("LED light has more than one reflector means"), Now U.S. Pat. No. 8,277,087, which discloses an arrangement similar that of the current invention in that the current invention may include a kaleidoscope means having more than one reflective means in the form of mirror or mirror-like means assembled into the kaleidoscope means; and Ser. No. 11/806,284 ("LED light has more than one optic means"), now U.S. Pat. No. 7,632,004, which discloses an arrangement similar to that of the current invention in that the current invention may apply more than one optics means in front of or in back of a kaleidoscope means to create, adjust, magnify, reduce, or enlarge an image, the more than one optics means including any combination or optics lens, optics mirror, laser hologram, laser grating film, or optics assembly. The current invention also has features in common with the inventor's U.S. Pat. No. 7,455,444 ("LED light has more than one LED light source") in that the current invention may use more than one LED in a matrix arrangements with circuit means, IC means, sensor means, switch means, brightness control means, color mixing means, color selection means, color freeze means, motor means, gear means, and/or turn-on and turn-off means to cause a certain number of LEDs to turn-on with desired color, brightness, light brightness output, light functions, matrix combinations, motor means, rotating means, or gear set means and emit light to pass through a kaleidoscope means, optics means, laser means, motor means, or gear means to obtain desired light patterns.

Additional patent applications of the inventor, which disclose features that may be utilized in connection with the present invention, include U.S. patent application Ser. Nos. 12/948,953; 12/938,564; 12/886,832; 12/876,507; 12/771,003; 12/624,621; 12/914,584; 12/318,471; 12/318,470; 12/834,435; 12/292,153 (now U.S. Pat. No. 7,871,192); Ser. No. 12/232,505 (now U.S. Pat. No. 7,832,917); Ser. No. 12/318,473 (now U.S. Pat. No. 7,832,918); Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. Nos. 12/886,832; 12/938,564; 12/948,953; and Ser. No. 13/021,107.

Furthermore, the inventor also has copending filings for light devices having interchangeable power sources for wall outlets AC power and energy storage means (direct current), including all kinds of combinations of prong mean, extension cords, adaptors, transformers, solar and wind power sources, batteries, and chemical and biological power sources, all of which can be interchanged for any AC or battery power source for desk top and plug in type projection light devices having built-in kaleidoscope means, the filings including U.S. patent application Ser. Nos. 12/318,473 and 12/940,255 (now U.S. Pat. No. 8,231,246).

The current invention thus may utilizes principles and structures from a variety of the inventor's patents or copending patent applications, such as: (1) a projection light device; (2) more than 1 optics means; (3) more than 1 LED; (4) more than 1 reflective means; (5) interchangeable power sources; (6) laser means; (7) adjustable focus and position changing; and (8) use of a motor and gear set for image adjustment and moving.

This application also has subject matter in common with U.S. patent application Ser. Nos. 12/710,561; 12/711,456; 12/771,003; 12/624,621; 12/622,100; 12/318,471; 12/318,470; 12/318,473; 12/292,153; 12/232,505; 12/232,035; 12/149,963; 12/149,964; 12/073,095; 12/073,889; 12/007,076; 12/003,691; 12/003,809; 11/806,711; 11/806,285; 11/806,284; 11/566,322; 11/527,628; 11/527,629; 11/498,874; 12/545,992; 12/806,711; 12/806,285; 12/806,284; 12/566,322; 12/527,628; 12/527,629; 12/527,631; 12/502,661; 11/498,881; 11/255,981; 11/184,771; 11/152,063; 11/094,215; 11/092,742; 11/092,741; 11/094,156. 11/094,155; 10/954,189; 10/902,123, 10/883,719; 10/883,747; 10/341,519; 12/545,992; and Ser. No. 12/292,580.

In particular, the following applications show light devices that have at least some features in common with included or optional features of the LED light device of the present invention: Ser. No. 12/710,561 ("LED power failure Light"); Ser. No. 12/711,456 ("LED light device has special effects"); Ser. No. 12/771,003 ("LED light device has more than 1 reflective means for plurality of image"); Ser. No. 12/624,621 ("projection device or assembly for variety of LED light"); Ser. No. 12/622,000 ("Interchangeable Universal Kits for all LED light"); Ser. No. 12/318,471 ("LED night light with pinhole imaging"); Ser. No. 12/318,470 ("LED night light with Projection features"); Ser. No. 12/318,473 ("LED night light with laser or hologram element"); Ser. No. 12/292,153 ("LED night light with Projection or imaging features"); Ser. No. 12/232,505 ("LED night light with Projection features"); Ser. No. 12/149,963 ("Removable LED light device"); Ser. No. 12/149,964 ("Surface Mounted Device with LED light"); Ser. No. 12/073,095 ("LED Track light device"); Ser. No. 12/073,889 ("LED light with changeable position with Preferable power source"); Ser. No. 12/007,076 ("LED light with changeable geometric system"); Ser. No. 12/003,691 ("LED light with changeable geometric dimension features"); Ser. No. 12/003,809 ("LED light with changeable features"); Ser. No. 11/806,711 ("Multiple LED light with adjustable angle features"); Ser. No. 11/806,285 ("LED Night light with outlet device"); Ser. No. 11/806,284 ("LED Night light with more than 1 optics means"); Ser. No. 11/527,628 ("Multiple function Night light with air freshener"); Ser. No. 11/527,629 ("LED Night light with interchangeable display unit"); Ser. No. 11/498,874 ("Area illumination Night light"); Ser. No. 11/527,631 ("LED Time piece night light"); Ser. No. 12/545,992 ("LED time piece Night light"); Ser. No. 12/292,580 ("LED Time Piece Night light"); Ser. No. 11/498,881 ("Poly Night light"); Ser. No. 11/255,981 ("Multiple light source Night Light"); Ser. No. 11/184,771 ("Light Device with EL elements"); Ser. No. 11/152,063 ("Outlet adaptor with EL"); Ser. No. 11/094,215 ("LED night light with liquid medium"); Ser. No. 11/094,215 ("LED Night light with Liquid optics medium"); Ser. No. 11/092,741 ("Night light with fiber optics"); Ser. No. 10/883,747 ("Fiber Optic light kits for footwear"); Ser. No. 11/498,874 ("Area Illumination for LED night light"); Ser. No. 11/527,629 ("Time Piece with LED night light"); Ser. No. 11/527,628 ("Multiple Function Night light with Air Freshener"); Ser. No. 11/806,284 ("LED Night light with more than one optics mediums"); Ser. No. 11/806,285 ("LED Night Light with multiple function"); and Ser. No. 11/806,711 ("Multiple LEDs Light with adjustable angle function").

The applications of the inventor in general all apply physics or optics theory to a night light supplied with power from an outlet, battery, solar, or other power source. The present invention uses the physics or optics theory to create a plurality of LED light images on a surface. More specifically, the current invention uses more than one reflective means to transform a single LED spot light into a plurality of images on a surface to be seen by viewer. The principles of the invention may be applied to night lights of various types, including night lights disclosed in the above-listed patents and patent applications of the inventor, which may be powered by a variety of power sources, such as an outlet, batteries, solar, wind, or chemical power sources.

Because of the persistence of vision effect, caused by the human eye response time of more than 1/24 (41,67) to 1/16 (0.0625) seconds, when an object moves faster than the human eye response time, the last image will stay in the human eye and brain for an extended period of time. This theory can utilized to save power by causing an LED or LEDs to flash with a very short on-time of around 10 msec or less. This principle is similar to that of a motion picture in which, if an object in front of human eye is displayed in 16-24 pictures per second, people will think all pictures are continuous. Hence, the current invention uses a related circuit, control means, IC, and/or micro controller to cause an LED light device to blink at a rate that is much faster than 16-24 times (cycles) per second, with the LED or LEDs being turned on for 10% of each cycle and off for 90% of the cycle to save up to 90% of power consumption or increase battery life by nine times more than the full steady-ON condition. This is a significant power saving for all battery power source applications. It will be appreciated that new LEDs may be coming soon to enable the LEDs to have an even quicker response time of less than 10 msec, and possibly less than 5 msec or 2 msec, to provide even greater power saving. such adjustment of the duration of each cycle's turn-on and turn-off duration time will cause even more power saving to meet the green world concept. This is one of the very important concepts of the current invention.

Further cost saving can be achieved in the case of a battery powered unit by using a circuit with proper electric components, parts, and accessories to raise the voltage output of the batteries to trigger the LED or LEDs even though the number of batteries is less than that normally required to generate the required voltage. This can counter the tendency of people to use a large quantity of batteries and save substantial cost, which is another important advantage of the current invention.

A preferred embodiment of the current invention includes an LED night light with more than one reflective means within the geometric shape optics means that allow a plurality of LED light beams to pass through or reflect within the more than one reflector means inside the optics means. The LED night light includes at least one LED arranged on the inside of the partial transparency geometric optics means having more than one reflective means, at least one second reflective means within the geometric optics means which can reflect LED light beams from its surface to first or other reflective means surface(s) back and forth so that some of the LED light beams are reflected and others travel within the optics means and pass through to outside.

In this embodiment, a plurality of the LED beam can be projected outside through the said surface(s). Furthermore, at least one of the reflective means may be partially transparent so that the plurality of LED light beams pass through from the said surface(s) thereof. The other plurality of light beams are reflected or retro-reflected within the other reflector means and pass through some other surface(s).

The LED or LEDs of this embodiment are preferably connected with circuit means, power means, contact means, conductive means, switch means, sensor means, motor means, spin means, rotating means, gear set means, speed control means, printed circuit means, integrated circuit (I.C.) means and/or related parts and accessories to cause the LED or LEDs to turn on and off according to a predetermined time period, functions, colors, and/or effects to provide a desired lighting performance.

In the above-described preferred embodiment, the reflective means may be a mirror, chrome finished piece, polished piece, double-side mirror, or any surface having reflective and passing though both optics properties suitable to the current invention.

The partially transparent or see-through properties can be provided by a transparent piece, colored transparent piece, or any other piece that allows light beams to pass therethrough. A power source of this embodiment can be in the form of an outlet, batteries, solar power, chemical power, or wind power.

The LED or LEDs can be selected from any combination of single color, multiple color, multiple piece, standard, and special LED assemblies, LED number from 1 to N (N can be any number) to arrange in a desired matrix spacing.

The distance, position, orientation of the reflective means may be changed based on the selected geometric shape of the optics means. The LED or LEDs can be arranged to have different numbers, position, color, IC chips, control means, circuit means, functions, and brightness to create a desired plurality of light patterns, shows, color changing, image changing, or moving effects visible on a surrounding surface (s) such as a wall, ceiling, floor, or other desired surface(s).

The geometric optics means can have any shape and any desired combination of optical elements, including a lens, reflective lens, convex lens, concave lens, laser lens, or hologram lens, the lens being situated on the inner or outside surface, or on all surfaces, to obtain the desired light effects.

According to another preferred embodiment of the invention, an LED light device having power saving features includes at least one LED or LEDs for a light source, at least one housing having space to install circuit means, conductive means, electric components parts and accessories, switch means, sensor means, an integrated circuit (IC), and/or a micro controller to connect with a conventional market-available power source to cause the LED or LEDs to turn on and turn to provide predetermined functions or effects, with a predetermined duty cycle, color, and/or brightness.

The power-saving features are obtained by using the control means to cause the LED or LEDs turn-on for only a certain percentage of each cycle. In particular, the turn on time is selected to meet the persistence of vision of the human eye, so as to take advantage of the human eye's response time of 1/24 to 1/16 second so that the blinking LED or LEDs looks as if it were continuously on.

According to yet another embodiment of the invention, an LED light device having cost saving features includes at least one LED or LEDs as a light source, at least one housing having space to install circuit means, conductive means, electric components parts and accessories, switch means, sensor means, an integrated circuit (IC), and/or a micro controller to connect with a conventional market-available power source, preferably batteries, to cause the LED or LEDs to turn on and turn off according to a predetermined function or effects, duty cycle, color, and/or brightness.

In this embodiment, cost saving is obtained by providing batteries having a total voltage that is less than the LED trigger voltage and by providing electric components and related parts and accessories to increase the voltage output of the batteries to greater than the LED trigger voltage.

As noted above, the current invention uses a geometrically-shaped optics-means having built-in more than one reflective means to create a plurality of LED light beams that pass through or are reflected or retro-reflected by the more than one reflective means. The relative distance, position, and/or orientation of the more than one reflective means (and optional additional) reflective means will result in different light beam performance. This is a very low cost and simple way to make a splendid and eye catching light projection unit for people, with any desired power source such as a battery, USB power, outlet power, generator power, chemical power, solar power, wind power or another equivalent power source from the marketplace.

BRIEF DESCRIPTION OF THE DRAWINGS

FIGS. 1, 2, and 2-1 show a first preferred embodiment of the current invention having prong means with plenty of reflective means inside a geometric optics-means and plenty of convex-lens means to cause a plurality of light beams to be emitted in order to project images to be seen by a viewer.

FIGS. 1-1, 2-2, and 2-3 show a variation of the first preferred embodiment of the current invention having AC power-means with plenty of reflective means inside the geometric optics-means and plenty of convex-lens means to cause a plurality of light beams to be emitted in order to project images to be seen by a viewer.

FIGS. 1-2, 2-4, and 2-5 show another variation of the first preferred embodiment of the current invention having DC power-means, USB power, or interchangeable power sources with plenty of reflective means inside the geometric optics-means and plenty of convex-lens means to cause a plurality of light beams to be emitted in order to project images to be seen by a viewer. FIG. 2-5 shows one of the splendid light images created by the current invention in a yellow color image.

FIGS. 3 and 3-1 show a preferred construction for an LED light having more than one reflect-means and a motor means.

FIGS. 4, 4-1, and 4-2 illustrated the manner in which light beams are emitted to a first reflective means and then to second, third, and fourth reflective means within the optics means of the first preferred embodiment. Each reflect-means has a convex shape on the outside so it acts as a convex-lens to allow the light beams to be emitted out and enable the projected image to be seen. FIG. 4 shows that the first preferred embodiment's first, second and other reflective means may have different mutual distances, positions, and orientations.

DETAILED DESCRIPTION OF THE PREFERRED EMBODIMENTS

Figure 3:
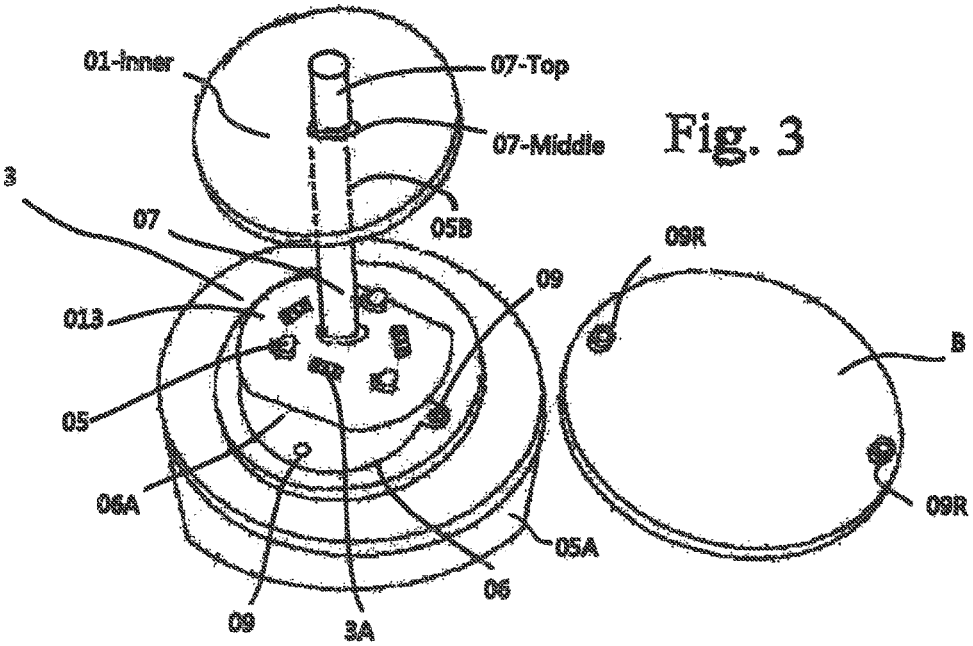
Figures 1, 3:
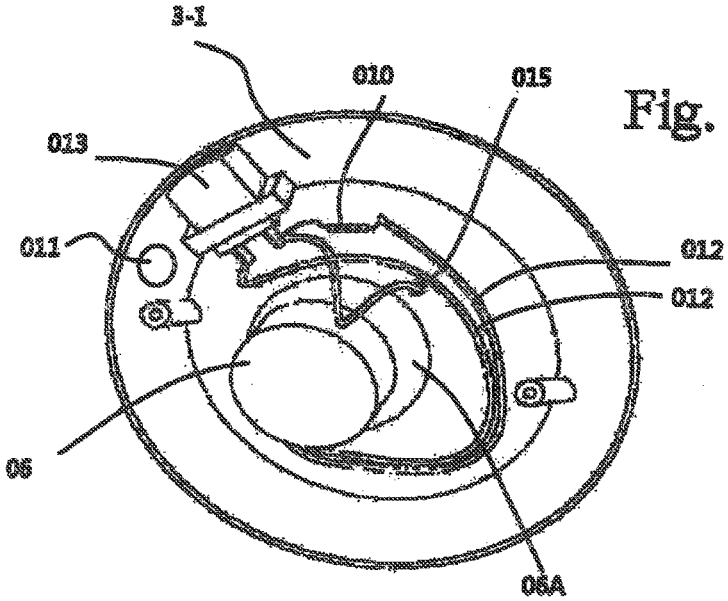

As shown in FIG. 1, a plug-in type LED projection light having more than one reflect-means includes prong means to connect with, for example, a wall outlet, extension cord, power station, or desk lamp outlet receptacle. The LED projection light can project a light image to a ceiling, wall, or floor using a more than one optics-means construction. The optics-means has more than one convex lens, each including an inner, mirror-like polished reflector and a round convex shape on the outside so that each becomes a convex-lens. Hence, the current invention provides semi-spherical optics-means with a built-in plurality of reflect-means and arranged such that light beams emitted by an LED are reflected off of multiple reflect-means until the light beams pass through to outside the convex-lenses formed by the reflect-means.

As shown in FIG. 1, the ball-shaped optics-means projects a splendid color image to all surrounding areas. The LEDs may have any desired color, specifications, size, or functions and each LED can have its own emitting direction, orientation, or angle in any direction because the inner surface of the optics-means has more than one reflect-means so that even though the LED light emitting angle is narrow, after the light beam has been reflected, the light will be emitted from all regions of the ball shape as a result of using (1) more than one LED, (2) more than one reflect-means, and/or (3) more than one optics-means, with power being supplied by, for example, interchangeable power sources such as the ones described in the inventor's U.S. patent application Ser. Nos. 12/318,471; 12/318,470; 12/834,435; 12/292,153 (now U.S. Pat. No. 7,871,192); Ser. No. 12/232,505 (now U.S. Pat. No. 7,832,917); Ser. No. 12/318,473 (now U.S. Pat. No. 7,832,918); Ser. No. 12/624,621 (now U.S. Pat. No. 8,303,150); Ser. No. 12/771,003 (now U.S. Pat. No. 8,408,736); Ser. No. 12/876,507 (now U.S. Pat. No. 8,083,377); Ser. No. 12/886,832; 12/938,564; 12/948,953; and Ser. No. 13/021,107. FIG. 1-1 shows a variation of the embodiment of the FIG. 1 in which the light device includes an alternating current (AC) power unit including an AC adaptor, transformer, and/or AC wires to cause the LED projection light to project a splendid light image.

FIGS. 1-2 and 2-4 show a variation of the embodiment of the FIG. 1 in which the light device includes a direct current (DC) power unit which may include any direct current device, such as batteries or energy storage means and sources of solar power, wind power, or chemical power.

Alternatively, interchangeable power sources such as the ones disclose in the inventor's U.S. Pat. No. 8,434,927 may be used.

FIGS. 2 and 2-1 show a plug-In type AC-powered LED light device with a base installed on the plug-in housing that contains inner circuit means, LEDs, sensor means, switch means, control means, and/or optional motor means to project the image to a ceiling, wall, or floor with plenty of color and movement (if the motor means are included). The optics-means of FIG. 2 has a plurality of flat mirror-polished reflect-means on the inside and a round convex surface on the outside of each reflect-means to form a convex-lens that not only reflects light beams but also allows light beams to pass though.

As shown in FIGS. 2-2 and 2-3, the AC power unit may include a receptacle for receiving a transformer, adaptor or AC wires. The adaptor or AC wires drive a circuit to cause LEDs to turn on and project light to a desired area(s). The power unit can alternatively use USB wires to get power from a USB port, as shown in FIG. 2-5.

FIG. 3 shows a projection light having more than one reflective-means within one optics-means that allows light to pass through a convex-lens and reflect within the reflective-lens to project an image onto a ceiling, walls, or floor.

FIG. 3-1 shows the inner construction of a preferred projection light having built-in motor means fixed on a housing by a screw. The motor means cooperates with a gear-set means to reduce the motor's rotating speed to a slower speed so as to prevent the projected image from moving too quickly, which could make people uncomfortable. FIG. 3-1 also shows a switch means, electric parts and accessories, and conductive wires to connect with circuit means to provide power.

FIG. 4 shows the manner in which a light beam reflects within the more than one reflect-means on an inner side of optics-means which are in the shape of a sphere. The light beam then passes through an outside convex-lens to project an image onto a ceiling, walls, or floor, thereby demonstrating principles of: (1) including more than one reflect-means in an optics-means; (2) light projection through the more than one optics-means, which have an inner side that is a flat mirror-polished reflector and an outside having a convex-shape to form a convex-lens; (3) the convex lenses together forming a semi-spherical geometric shape; (4) the optics means mounted in a second semi-spherical sphere ball that forms a base of the light device.

FIG. 4-1 shows another viewing angle for the two half-shaped spheres with base to form the optics-means which has more than one optics-means. Each one of the optic-means has more than one reflect-means to form a half-sphere geometric ball. This is similar in concept to that described in the inventor's earlier U.S. Pat. Nos. 7,632,004 and 8,277,087, which also describe light devices having more than one reflect means. U.S. Pat. Nos. 7,455,444 and 8,434,927 respectively disclose night lights with more than one LED and night lights with interchangeable power sources that may be utilized in connection with the current invention.

FIG. 4-2 shows an inner side of the two geometrically-shaped optical-means having more than one reflect-means inside each of the optics-to overcome the LED's narrow light beam angle. As illustrated, all LEDs have different directions for emitting light beams to the reflect-means so that even though the light angle is narrow, it is not a problem because the light emitted from the LEDs will hit the first reflect-means, then hit second, third, fourth, and possibly additional reflect-means until the light beams have completely passed through the convex-lenses formed by the reflect-means. A motor can be added to cause the image to rotate.

In the preferred embodiments, images are created based on the relationship between the first reflect-means and the second reflect-means and/or other reflect-means. The light device can employ any kind of design, shape, display, or geometric arrangement of the more than one reflect-means.

Although specific preferred embodiments of the current invention are described above, it is to be appreciated that all alternative, equivalent, same-function and/or same-skill-or-theory variations, modifications, replacements, arrangements, or constructions may still fall within the current scope of the invention.

The invention claimed is:

1. An LED light, comprising:

at least one optics piece having more than one section, area, or surface having reflective refractive properties to create an image or lighted patterns having a wider viewing angle or range;

at least one LED;

wherein said sections, areas, or surfaces are at predetermined relative distances, positions, and/or orientations with respect to the at least one LED; and wherein said sections, areas, or surfaces of the optics piece are arranged to project said image and/or lighted patterns to at least one surface of a structure that is external to and away from the LED light, wherein said at least one LED is connected to a power source by conductors and circuitry for causing said at least one LED to turn on and off for a predetermined period of time to provide predetermined functions, colors, and effects, and wherein light beams emitted from the at least one LED are reflected and/or refracted by more than one said section, area, and/or surface of said optics piece to create or project the image, light beams, or lighted patterns to said at least one surface of a structure that is external to and away from the LED light, wherein the optics piece is a front cover having a dome or at least half ball shape having a wide opening on top or front of the LED light to allow the light beams to be emitted out and project the wider range image and/or patterns to the external location as the light beams are transmitted through the dome or half ball shape, and wherein the LED light is powered by plugging a male plug of an LED light wire into an AC outlet of an extension cord or wall, or by plugging built-in prongs into the AC outlet or extension cord.

2. A LED light having at least one optics piece as recited in claim 1, wherein sections, areas, and/or surfaces of said at least one optics piece includes sections, areas, and/or surfaces of a mirror or a lens having a chrome finish, a fine polish, or a double-sided mirror finish.

3. A LED light having at least one optics piece as recited in claim 1, wherein said optics piece has see-through properties to (a) allow light to pass through a uniform thickness top cover; (b) create a plurality of images or light spots; (c) enlarge and change a direction of an image or lighted spots; and/or (d) create a plurality of light spots by including a plurality of tiny optical lenses.

4. A LED light having at least one optics piece as recited in claim 1, wherein said power source is selected from the group consisting of an outlet, batteries, solar power, chemical power, and wind power to provide electricity to drive said at least one LED to emit light beams.

5. A LED light having at least one optics piece as recited in claim 1, wherein an additional motor and gear set fit within the LED light to cause rotation of the at least one LED, a carrier of the at least one LED, and/or the optics piece and thereby provide moving image projection functions, effects, or performance.

6. A LED light having at least one optics piece as recited in claim 1, wherein said at least one LED is rotated by a motor or rotating device and the at least one LED is selected from a single or multiple color LED, multiple LEDs, a standard LED, and a custom LED assembly.

7. A LED light having at least one optics piece as recited in claim 1, wherein said male plug is arranged to be plugged into an AC wall outlet, an AC power receptacle, an AC extension cord outlet, an AC power strip outlet or a cigarette lighter.

8. A LED light having at least one optics piece as recited in claim 1, wherein said optics piece is a unit that includes parts or sections selected from one or more of a light-transmitting lens, reflective lens, convex lens, concave lens, and optics lens assembly having a plurality of optics lenses.

9. An LED light, comprising:

more than one optics piece having reflective and refractive properties to create an image and/or lighted patterns having a wider viewing angle or range, and at least one LED;

wherein said optics pieces are installed at predetermined relative distances, positions, and/or orientations with respect to the at least one LED; and wherein said optics pieces include sections, areas, or surfaces arranged to project said image and/or lighted patterns to at least one surface of a structure that is external to and away from the LED light, wherein the at least one LED is selected from any combination of a single color, multiple color, multiple piece, standard, and special LED assembly, wherein said at least one LED is connected to a power source by conductors and circuitry for causing said at least one LED to turn on and off for a predetermined period of time to provide predetermined functions, colors, and effects, and wherein a light beam emitted from the at least one LED is reflected and/or refracted by more than one said reflective and/or refractive section, area, or surface of said optics pieces to create or project the image, light beams, or lighted patterns to said at least one surface of a structure that is external to and away from the LED light, wherein one or more of the optics pieces form a top or front cover having a dome or at least half ball shape to allow light beams to be transmitted through the top or front cover and project the wider range image and/or patterns to the external location, wherein the LED light is one of: (A) an AC light powered by plugging a male plug of an LED light wire into an AC outlet or extension cord, or by plugging built-in prongs into the AC outlet or extension cord; and (B) a DC light, and wherein the LED light further includes a motor, gear set, movement, and/or rotating device to cause rotation of the at least one LED, a carrier of the at least one LED, and/or one or more of the optics pieces and thereby provide motion effects.

* * * * *